United States Patent [19]

Kalvinskas et al.

[11] 4,391,609

[45] Jul. 5, 1983

[54] HYDRODESULFURIZATION OF CHLORINIZED COAL

[75] Inventors: John J. Kalvinskas, South Pasadena; Naresh K. Rohatgi, West Covina, both of Calif.

[73] Assignee: The United States of America as represented by the Administrator of the National Aeronautics and Space Administration, Washington, D.C.

[21] Appl. No.: 315,587

[22] Filed: Oct. 30, 1981

[51] Int. Cl.[3] ..... C10L 9/10

[52] U.S. Cl. ..... 44/1 SR; 201/17

[58] Field of Search ..... 44/1 SR; 201/17

[56] References Cited

U.S. PATENT DOCUMENTS

| | | | |
|---|---|---|---|
| 2,726,148 | 12/1955 | McKinley et al. | 44/1 SR |
| 3,640,016 | 2/1982 | Lee et al. | 44/1 SR |
| 4,054,421 | 10/1977 | Robinson et al. | 44/1 |
| 4,081,250 | 3/1978 | Hsu et al. | 44/1 SR |
| 4,118,201 | 10/1978 | Tsoung | 44/1 |
| 4,133,367 | 1/1979 | Nuttal, Jr. et al. | 423/244 |
| 4,203,960 | 5/1980 | Bauer et al. | 423/461 |
| 4,208,307 | 1/1980 | Lutz | 252/502 |
| 4,233,034 | 11/1980 | Miller et al. | 44/1 |
| 4,325,707 | 4/1982 | Kalvinskas et al. | 44/1 SR |
| 4,334,888 | 6/1982 | Corcoran et al. | 44/1 SR |

*Primary Examiner*—Charles F. Warren
*Assistant Examiner*—Margaret B. Medley
*Attorney, Agent, or Firm*—Paul F. McCaul; John R. Manning; Thomas H. Jones

[57] ABSTRACT

A method of desulfurization is described in which high sulfur coals are desulfurized by low temperature chlorinolysis (12) of coal in liquid media, preferably water, followed by hydrodesulfurization (26) at a temperature above 500° C. The coals are desulfurized to an extent of up to 90% by weight and simultaneously dechlorinated to a chlorine content below 0.1% by weight. The product coals have lower volatiles loss, lower oxygen and nitrogen content and higher fixed carbon than raw coals treated with hydrogen under the same conditions.

Heating the chlorinated coal to a temperature above 500° C. in inert gas such as nitrogen results in significantly less desulfurization.

8 Claims, 5 Drawing Figures

HYDRODESULFURIZATION OF CHLORINIZED COAL

DESCRIPTION

Origin of the Invention

The invention described herein was made in the performance of work under a NASA contract and is subject to the provisions of Section 305 of the National Aeronautics and Space Act of 1958, Public Law 83-568 (72 Statute 435; 42 U.S.C. 2454).

TECHNICAL FIELD

The present invention relates to desulfurization of coal and carbonaceous substances and, more particularly, to a process for simultaneously removing sulfur and chlorine from chlorinized coal.

BACKGROUND ART

The U.S. reserve of coal is about 3 trillion tons. Although the most abundant (80%) fossil fuel in America is coal, the U.S. consumption pattern is quite a reversal of form in terms of utilization, with coal representing only 17%, oil and gas about 78%.

The demand for all fossil fuels combined is expected to double by the year 2,000, even with increasing the use of nuclear power. While the domestic supply of crude oil and natural gas is not likely to keep pace with the energy demand, coal can play an important role in filling such a gap and thus reduce the requirements for imported supplies of oil and gas.

Coal, the fossilized plant life of prehistoric times, contains various amounts of sulfur due to the nature of its origin. Under most existing commercial technology, the generation of electricity from coal poses environmental problems because of sulfur oxides and particulate emissions. Since most of the coals in this country, particularly the Eastern and Midwestern coals, have high sulfur content (>2%) there is a need for an economical process of converting high sulfur 2% coals to clean fuel (<1.2 lbs. of $SO_2$ emission per million B.t.u. by EPA standard) in order to utilize coal as a source of energy without causing serious air pollution. So the need for converting massive coal reserves to clean-burning solid fuel, liquid fuel and pipeline quality gas is self evident. If the vast coal reserve is converted to clean fuel, it can supply most of the energy needs of the United States for the next three centuries.

At the present time, about one-half of the electric power in the United States is generated from natural gas and petroleum; most of the other half is from coal. If the coal is converted to clean fuel for electric utilities, petroleum and natural gas would be released for other essential uses, especially as a starting material for the synthetic rubber and plastics industry.

Sulfur in coal occurs in two types, generally in approximately equal amounts of inorganic sulfur primarily as pyrites with minor amounts of sulfates and of organic sulfur in the forms of thiophene, sulfide, disulfide and mercaptan chemically bound in the organic structure of coal.

The sulfur oxides in the combustion gases of coal can be removed by stack gas scrubbing methods but those are expensive processes and produce large amounts of sludge. Hydrodesulfurization processes which remove sulfur from the fuel before combustion are effective. They are used extensively in petroleum desulfurization and many coal conversion processes under development. However, they are also expensive due to the cost of hydrogen and severe operating conditions required.

Physical separation methods can only remove the inorganic sulfur. Other desulfurization schemes under investigation such as TRW Meyers' process and Battelle Hydrothermal Coal Process are either primarily for inorganic sulfur removal or are operated at high temperature and pressure resulting in high process cost and in the physical disintegration of the coal.

A promising new process utilizing chlorine for removing organic and inorganic sulfur is described in U.S. Pat. No. 4,081,250. The three-stage process includes an initial room temperature chlorine treatment of coal slurry suspended in solvent/water media. After chlorinolysis a batch hydrolysis and solvent recovery is carried out. Finally, dechlorination at 300° C. to 450° C. yields a desulfurized coal product. This process requires use of a chlorine resistant solvent such as methyl chloroform which is recovered by steam distillation.

Ser. No. 156,790 filed May 12, 1980, demonstrates that an aqueous medium is an equally effective, if not superior, medium for the chlorinolysis-desulfurization reaction, and Ser. No. 250,646 filed Apr. 3, 1981, discloses increased sulfur removal from coal by selection of a solvent having a solubility parameter matching peaks within the solubility parameter spectrum of coal.

However, even though the chlorinolysis process has proven to be an effective process for pre-combustion reduction of sulfur by about 60 to 70% of original sulfur content, only 20 to 30% of organic sulfur is removed. The treated coal contains significant amounts of chlorine. The chlorinized-desulfurized coal process will not meet new source performance standards for sulfur emissions of a maximum allowable emission of 1.2 pounds of $SO_2$ per $10^6$ B.t.u. or 0.7 wt.% sulfur/12,000 B.t.u./lb. coal for all coals.

The organic sulfur remaining after chlorinolysis is extremely difficult to remove, especially without excessive loss of heating value and without expenditure of significant amounts of energy. Additional desulfurization is required. An investigation of conducting additional desulfurization during dechlorination by raising the temperature from 400° C. to 700° C. showed some additional increase in desulfurization but not substantially above that normally found at 400° C. The addition of oxidizing agents such as $NO_2$, $SO_2$ of $O_2$ to the inert nitrogen atmosphere in the dechlorination stage also showed no improvement in desulfurization.

DISCLOSURE OF THE INVENTION

It has now been discovered in accordance with the invention that substantial further amounts of sulfur are removed from chlorinated coal by subjecting the coal to a reducing atmosphere at an elevated temperature of at least 450° C., preferably above 500° C. Temperatures above 800° C. are not believed practical due to increased energy expense and increased volatilization of the coal solids. The process of the invention results in removal of up to 90% of sulfur. The process of the invention surprisingly results in substantially higher desulfurization than raw, unchlorinized coals subjected to the same processing conditions.

The process of the invention provides less ash build-up, smaller loss of coal organics and even increases in heating value. Dechlorination can be simultaneously conducted during the further desulfurization stage of the invention resulting in significant savings in energy, cost and reduced handling.

The desulfurized and dechlorinized process produces improved feedstock for combustion and gasification operations as the final treated coal is rendered completely non-caking and non-swelling. The organic sulfur removal is a significant advantage of the inventive process. Being chemically bound to the organic structure of coal this sulfur is most difficult to remove without incurring high process cost. The desulfurization process of this invention can be used as a pretreatment step before combustion or gasification. The processing scheme is simple and is compatible with current coal processing technologies. Furthermore, no feeding or filtration problems are expected. Although the process of the invention requires use of hydrogen and entails some reduction in volatiles, it is believed that the process can meet NSPS standards for sulfur emissions and achieve an acceptable coal quality for utilities and industrial boilers.

These and other features and attendant advantages of the invention will become readily apparent as the invention becomes better understood by reference to the following detailed description when considered in conjunction with the accompanying drawings.

DETAILED DESCRIPTION OF THE INVENTION

Figure 1:
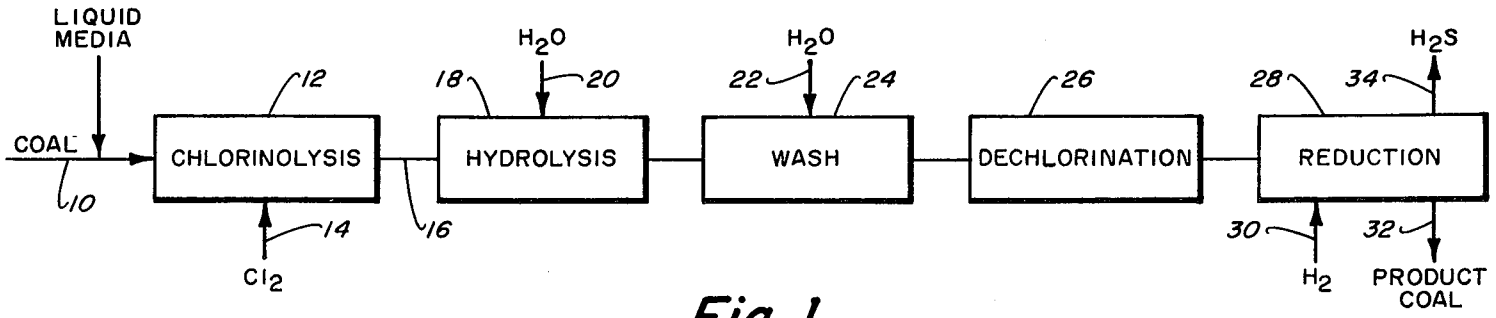
FIG. 1 is a block diagrammatic view of the chlorinolysis—hydrodesulfurization process in accordance with the invention.

FIG. 1 depicts a very generalized process for practice of the invention. Referring to FIG. 1, pulverized coal is mixed with a liquid media in line 10 to form a slurry containing from 15 to 60% by weight of coal, preferably 20 to 40% by weight. The liquid media provides a mass transport media to carry chlorine into the pores of the coal. The slurry is fed to chlorinolysis unit 12 where chlorine is continuously added through line 14. The chlorine is provided in a stoichiometric ratio of 3.5 to 4.4 moles of chlorine per mole of total sulfur. The particular amount of chlorine added to the coal slurry depends on the size of the coal, duration of chlorination, chlorine injection rate, temperature and amount of sulfur in the coal. Typically, from 10 to 15% by weight of chlorine is added to high sulfur coal which contains at least 2% total sulfur.

The chlorinated coal is delivered through line 16 to hydrolysis unit 18 in which it is suspended in water from line 20 in order to hydrolyze the sulfur reaction products to soluble sulfates. Hydrolyzed coal is then washed with water from line 22 in washing unit 24. Washed coal is dechlorinated in unit 26 and is then subjected to further desulfurization in reduction unit 28 in which it is contacted with reducing agent, preferably a continuous flow of gaseous reducing agent such as hydrogen through line 30. Hydrogen reacts with the remaining sulfur to form $H_2S$ which is removed through line 34. Product coal is recovered through line 32. The coal is heated to a temperature of at least 450° C. during the further desulfurization in unit 28.

Chlorinolysis is conducted at low temperature, generally below 100° C., preferably from 20° C. to 100° C. The chlorinolysis step can be operated at ambient, atmospheric pressure or at elevated pressure of from 1 to 5 atmospheres. The coal slurry should be agitated during chlorinolysis. Chlorine dispersion into the coal slurry is significantly improved by use of good agitation. During chlorinolysis thhe pyritic and organic sulfur in the coal is converted into sulfate which dissolves during hydrolysis. Effective desulfurization is achieved at a chlorine flow rate of 1.0 to 50 SCF per hour, per kilogram of coal, usually about 3 to 25 SCF per hour, per kilogram of coal, in about 0.1 to 3 hours.

After hydrolysis is completed hydrolized coal is then dechlorinated to a chlorine content below 1.0 weight percent, preferably to a chlorine content below 0.1% by heating the coal with inert gas to a temperature from 300° C. to 450° C. The hydrogen chloride evolved during chlorination and dechlorination can be recovered as a valuable product or can be converted to chlorine gas for recycle by commercial process such as the KEL-CHLOR process.

The preferred method of further reducing the sulfur content is hydrodesulfurization in which the coal particles are contacted with the gaseous reducing agent, preferably hydrogen, or a gas capable of donating hydrogen such as ammonia or synthesis gas, at a temperature of at least 500° C. to convert the remaining pyritic and organic bound sulfur to hydrogen sulfide.

As previously discussed, chlorinolysis can be conducted in organic solvent or in aqueous media. Due to the simplicity and economics, it is preferred to conduct chlorinolysis in water since separate hydrolysis is not required and water is much cheaper than methylene chloride, methanol or other solvents discussed previously. If organic liquid media is utilized, it is preferred that the organic media contain from 20 to 40% by volume of water so that hydrolysis can be initiated during chlorinolysis.

It has further been discovered in accordance with the invention that dechlorination and the post-treatment desulfurization step of the invention can be conducted simultaneously by simply heating the hydrolyzed and washed coal in a reducing atmosphere such as hydrogen to a temperature of at least 500° C. The treated coal will evolve both HCl and $H_2S$ gases in addition to the volatiles during this step.

Figure 2:
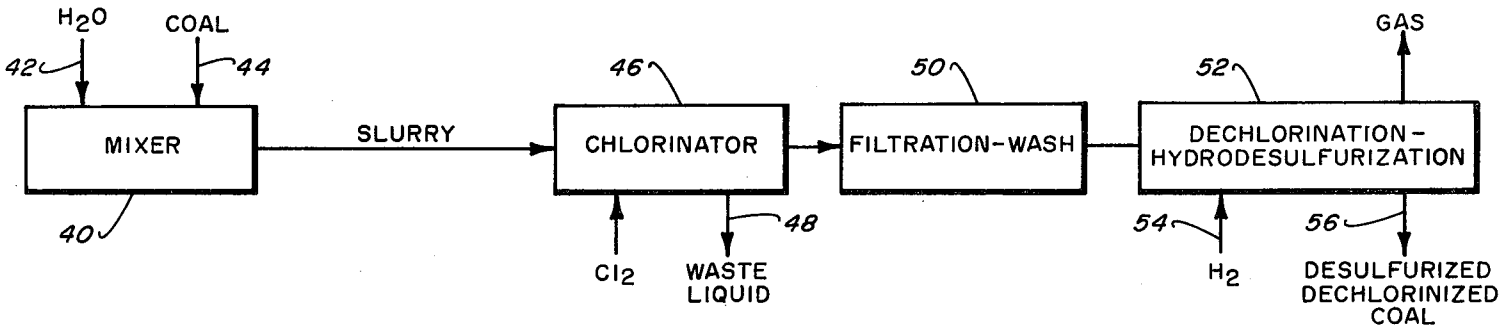
FIG. 2 is a schematic view of a preferred coal processing system in accordance with the invention.

Referring now to FIG. 2, the preferred coal desulfurization system in accordance with the invention includes a mixer 40 receiving a flow of water 42 and pulverized coal 44 to form a slurry which is fed to chlorinator 46. Chlorine gas is continuously bubbled into the slurry in chlorinator 46 for time sufficient to convert a substantial amount of the sulfur compounds to soluble sulfates which are hydrolyzed by the aqueous slurry media and are removed through drain 48. The coal is then washed in filtration-washing unit 50 before being fed to hydrodesulfurization unit 52 in which it is heated to a temperature from 500° C. to 700° C. while hydrogen is continuously flowed into the unit through line 54. A desulfurized dechlorinized coal is recovered through line 56.

The desulfurization process is capable of desulfurizing diverse types of organic material in addition to coal such as petroleum, oil shale, industrial waste, particularly black liquor residue from sulfate or sulfite pumping. The coals suitable for desulfurization treatment in accordance with this invention can be bituminous, sub-bituminous or lignite containing at least 0.2% sulfur. Pulverization aids the chlorinolysis reaction rate. Typically, the coal will be pulverized and classified to 40 to 325 mesh, usually from 100 to 200 mesh.

The hydrodesulfurization step of the invention may be practiced at atmospheric or elevated pressure. It is expected that the kinetics and extent of desulfurization will increase at elevated pressure. Other hydrogenation kinetic enhancing additives such as transition metal salts may be added to the particles of coal during desulfurization. Particle sizes are also believed to influence kinetics. A faster reaction rate is expected with the larger surface area provided by smaller particle sizes. However, the process of the invention can be practiced with relatively coarse coal particles, minimizing costs in grinding and sizing of coal. Although the process is usually practiced in the presence of an excess of hydrogen, all that is stoichiometrically required is a sufficient amount of hydrogen to react with the sulfur remaining in the coal. However, the excess of hydrogen that is utilized during an industrial process can be recovered and recycled. The hydrogen may be flowed in a counter-current manner through the advancing coal stream to preheat the coal and simultaneously cool the gas in order to conserve energy.

The hydrodesulfurization process of the invention may be practiced in a fluidized bed, stationary bed or bed of coal moving on a conveyor or grate and the like. The process may be practiced in batch, or continuously, and the recovered coal may be stored or fed directly to a combustion furnace, gasification reactor or liquefaction reactor. The time necessary to further desulfurize the coal particles depends on the extent of desulfurization desired, the particle size, temperature, amount of hydrogen, etc. It is believed that a significant desulfurization can be achieved in an exposure of the chlorinated coal in a period of a few seconds. With larger particles the retention time is governed by heat and mass transfer limitations and may require up to 60 minutes or more for the hydrodesulfurization to be completed. A further embodiment of the hydrodesulfurization reactor is shown in FIG. 3.

Figure 3:
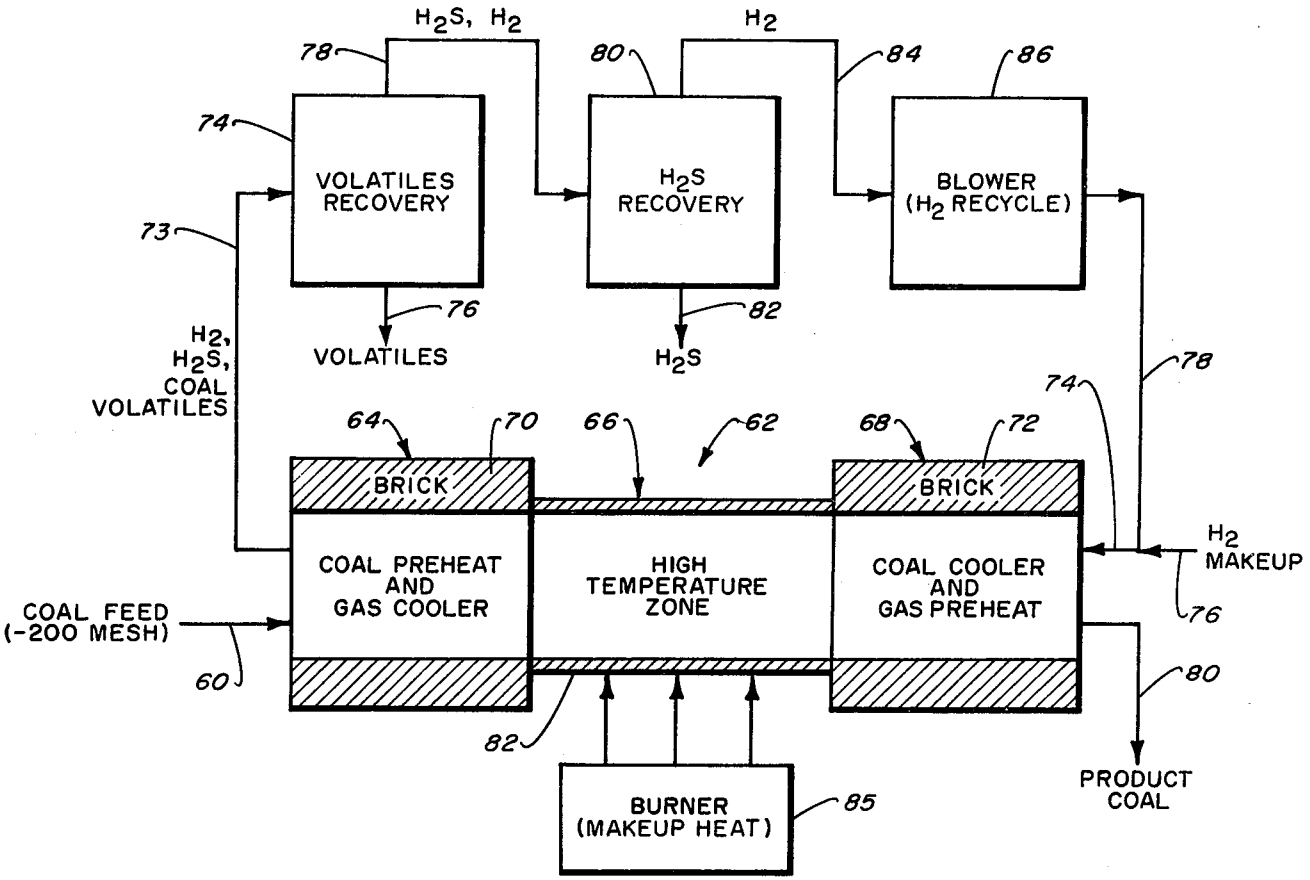
FIG. 3 is a process flow sheet.

Referring now to FIG. 3, the filtered and washed coal is fed through line 60 into the hydrodesulfurization unit 62 which comprises a preheater section 64, a reactor section 66 and a post-reaction cooler section 68. The section 64 and 68 are lined with insulating fire brick shells, 70, 72. A hydrogen stream 74 made up of make-up hydrogen 76 and recycled hydrogen 78 flows in counter-current direction to the coal feed 60. The hydrogen stream 60 cools the treated coal before it is recovered at 80. In the same time, the hydrogen is preheated before it flows through high temperature zone 66 where it is further heated and reacts with coal. The hydrogen then flows through the preheater section 64 as it transfers its heat to the coal and is cooled. The gas outlet line 73 will include coal volatiles, $H_2S$ and $H_2$. The gas stream is first processed in a unit 74 in which the coal volatiles are recovered through line 76 while the $H_2S$ and $H_2$ containing stream 78 is further processed in a separation unit 80 in which $H_2S$ is recovered 82 while the hydrogen is separated and flows through line 84 into blower 86 in which its pressure is increased in line 78 before injection into line 74.

The burner at 85 provides make-up heat to the high temperature zone 66 suitably by heating the shell 82 surrounding this heater directly or indirectly. The fuel for the burner may be provided by combusting the recycled volatiles 76 or by combusting a portion of the product coal 80. The reactor system illustrated in FIG. 3 can be operated on the basis of 0.35 SCF $H_2$/1 lb. coal required for total sulfur reduction of one pound of coal containing 3.28% sulfur at an elevated temperature in zone 66 of 500° C. to 700° C. The hydrogen recycled to cool product coal and to preheat incoming coal to 700° C. is 15.6 SCF $H_2$/1 lb. coal. The energy requirements to preheat coal to 700° C. is 380 Btu/lb. coal (3.14% of 12,000 Btu/lb. coal). The reactor 62 may be a rotary kiln with fire brick or equivalent construction.

EXAMPLES OF PRACTICE FOLLOW

EXAMPLE 1

Samples of coal were suspended in water or organic solvent at a ratio of liquid media to coal of 1/1 to 2/1 and fed to a continuous flow mini-pilot plant at a coal feed rate of two kg./hour. Chlorine was bubbled into the slurry at 70° C. for 45 to 60 minutes at a weight ratio of 8/1 $Cl_2$/S. The chlorinated coal was then washed at 70° F. in a horizontal belt, vacuum filler-spray wash at a ratio of fresh water/coal of 1/1 to form a filter cake containing 30% water.

Coals tested were initially ground and sieved to provide 100×200 mesh coal particles. However, particle sizes of −200 and −325 mesh were found to give improved desulfurization results over 100×200 mesh coal particles. As a result, a large number of test r-ns were made with −200 and −325 mesh coal particles. Particle size is noted under the operating conditions of each test run.

Various bituminous, sub-bituminous and lignite coals with total sulfur contents ranging between 0.47 weight percent to 3.87 weight percent were treated by chlorinolysis according to the procedure of Example 1. Approximate analysis data on experiments conducted on two bituminous coals, PSOC 282 and PSOC 276 is presented in the following Tables 1, 2 and 3 and in FIG. 4. ROM and chlorinated coals were subjected to nitrogen and hydrogen atmospheres at temperatures from 400° C. to 700° C. for 15 to 60 minutes.

TABLE 1

Proximate Analysis
Elevated Temperature Hydrogen Treated ROM and Chlorinolysis Processed Coal

| Example | Treatment | Volatiles (wt. %) | Fixed Carbon (wt. %) | Ash (wt. %) | HHV (Btu/lb.) |
|---|---|---|---|---|---|
| PSOC 276, HVA, Ohio No. 8, Harrison County, Ohio (Georgetown No. 24 Mine) | | | | | |
| ROM Coal | — | 37.2 | 51.3 | 11.5 | 12,755 |
| 2 | Chlorinolysis-$N_2$, 500° C. | 15.1 | 73.9 | 11.0 | 12,703 |
| 3 | Chlorinolysis-$H_2$, 600° C. | 12.8 | 75.1 | 12.1 | 13,069 |
| 4 | Chlorinolysis-$H_2$, 700° C. | 3.88 | 83.1 | 13.0 | 12,843 |
| 5 | Chlorinolysis-$H_2$, 700° C. | 5.71 | 80.2 | 14.1 | 12,632 |
| 6 | ROM-$H_2$, 700° C. | 5.14 | 76.4 | 18.5 | 12,113 |

TABLE 1-continued

| Example | Treatment | Volatiles (wt. %) | Fixed Carbon (wt. %) | Ash (wt. %) | HHV (Btu/lb.) |
|---|---|---|---|---|---|
| Proximate Analysis Elevated Temperature Hydrogen Treated ROM and Chlorinolysis Processed Coal | | | | | |
| PSOC 282, HVB, ILL. No. 6 Jefferson County, ILL, (Orient No. 6 Mine, Washed) | | | | | |
| ROM Coal | — | 33.8 | 59.5 | 6.7 | 13,092 |
| 7 | Chlorinolysis-$N_2$, 500° C. | 15.0 | 78.4 | 6.56 | 13,436 |
| 8 | Chlorinolysis-$H_2$, 700° C. | 5.12 | 87.1 | 7.72 | 13,600 |
| 9 | ROM-$H_2$, 700° C. | 6.36 | 83.8 | 9.88 | 13,252 |

TABLE 2

| Example | Treatment | Carbon (wt. %) | Hydrogen (wt. %) | Nitrogen (wt. %) | Sulfur (wt. %) | Chlorine (wt. %) | Oxygen (wt. %) |
|---|---|---|---|---|---|---|---|
| Ultimate Analysis Elevated Temperature Hydrogen Treated ROM and Chlorinolysis Processed Coal | | | | | | | |
| PSOC 276, HVA, Ohio No. 8, Harrison County, Ohio (Georgetown No. 24 Mine) | | | | | | | |
| ROM Coal | — | 71.6 | 5.67 | 1.28 | 3.91 | 0.16 | 5.87 |
| 2 | Chlorinolysis-$N_2$, 500° C. | 77.8 | 3.57 | 1.55 | 1.24 | 0.37 | 4.54 |
| 3 | Chlorinolysis-$H_2$, 600° C. | 80.5 | 2.46 | 1.62 | 1.06 | 0.09 | 2.17 |
| 4 | Chlorinolysis-$H_2$, 700° C. | 82.7 | 1.49 | 1.34 | 1.03 | <0.05 | 0.44 |
| 5 | Chlorinolysis-$H_2$, 700° C. | 82.0 | 2.21 | 1.21 | 0.78 | 0.00 | 0.00 |
| 6 | ROM-$H_2$, 700° C. | 76.0 | 1.37 | 1.11 | 2.45 | 0.00 | 0.57 |
| PSOC 282, HVB, ILL. No. 6 Jefferson County, ILL, (Orient No. 6 Mine, Washed) | | | | | | | |
| ROM Coal | — | 74.8 | 4.82 | 1.69 | 1.54 | 0.47 | 10.0 |
| 7 | Chlorinolysis-$N_2$, 500° C. | 81.8 | 3.04 | 1.93 | 0.67 | 0.47 | 5.53 |
| 8 | Chlorinolysis-$H_2$, 700° C. | 87.1 | 1.69 | 1.41 | 0.26 | 0.00 | 1.82 |
| 9 | ROM-$H_2$, 700° C. | 84.8 | 1.52 | 1.34 | 0.87 | 0.00 | 1.59 |

TABLE 3

| Example | Treatment | Ash (wt. %) | Volatiles Loss* (%) | Exp. Coal Loss (%) |
|---|---|---|---|---|
| Coal Volatiles Loss Based on Ash Balance Elevated Temperature Hydrogen Treated ROM and Chlorinolysis Processed Coal | | | | |
| PSOC 276, HVA, Ohio No. 8, Harrison County, Ohio (Georgetown No. 24 Mine) | | | | |
| ROM Coal | — | 11.5 | — | — |
| 2 | Chlorinolysis-$N_2$, 500° C. | 11.0 | — | — |
| 3 | Chlorinolysis-$H_2$, 600° C. | 12.1 | 9.1 | 7 |
| 4 | Chlorinolysis-$H_2$, 700° C. | 13.0 | 15.4 | 38 |
| 5 | Chlorinolysis-$H_2$, 700° C. | 14.1 | 22.0 | — |
| 6 | ROM-$H_2$, 700° C. | 18.5 | 37.8 | 30 |
| PSOC 282, HVB, ILL. No. 6 Jefferson County, ILL, (Orient No. 6 Mine, Washed) | | | | |
| ROM Coal | — | 6.70 | — | — |
| 7 | Chlorinolysis-$N_2$, 500° C. | 6.56 | — | — |
| 8 | Chlorinolysis-$H_2$, 700° C. | 7.72 | 9 | 17 |
| 9 | ROM-$H_2$, 700° C. | 9.88 | 32 | 35 |

*Based on ash balance

Figure 4:
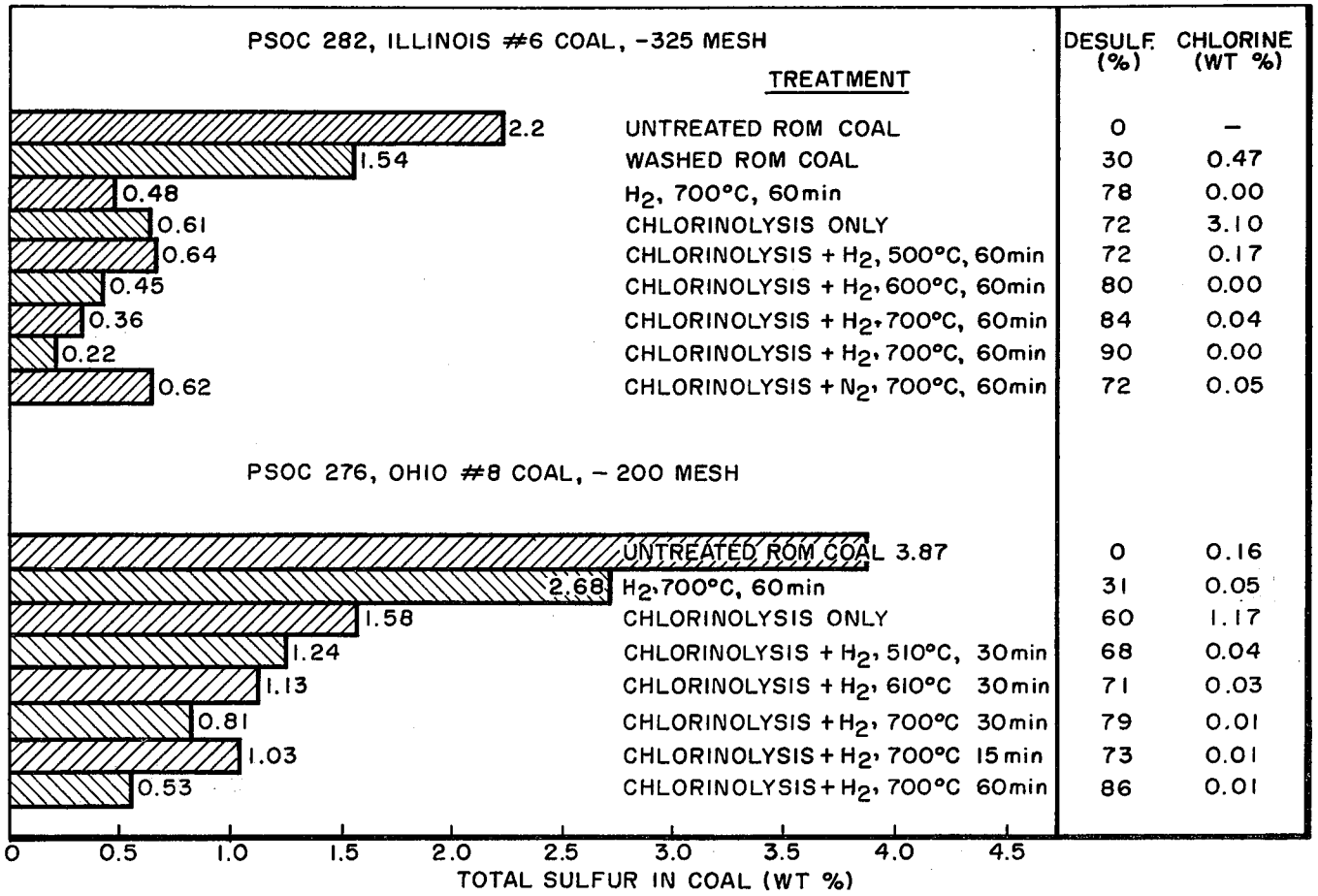
FIG. 4 is a series of bar graphs presenting data on hydrogen treatment of two varieties of coal.

Table 1 and FIG. 4 show that chlorinolysis processed coals provide 60 to 70% desulfurization. Hydrogen treatment of PSOC 276 and 282 coals at 700° C. for 60 minutes resulted in 30 to 78% desulfurization of raw coal but 84–90% desulfurization of chlorinolysis processed coals. Chlorine reduction was about the same or less than chlorinated coals treated with nitrogen under the same conditions. However, at temperatures above 500° C., hydrogen treatment of chlorinated coals resulted in substantial increases in desulfurization as compared to nitrogen treatment.

Proximate analysis (Table 1) showed that chlorinolysis reduced volatiles by 50%, increases fixed carbon, reduces ash while changing the heat value less than 5%. Hydrogen treatment of raw coals at 700° C. increases ash buildup and causes a loss of coal organics. However, hydrogen treatment of the chlorinized coal reduces ash buildup, causes a smaller loss of coal organics and an increase in heating value. Ultimate analysis (Table 2) showed increased reduction in hydrogen and oxygen and added increases in carbon content. Table 3 indicates that the hydrogen treatment of the invention results in coal volatiles loss of 9–22% whereas 32–38% of raw coal is volatilized under the same conditions.

Figure 5:
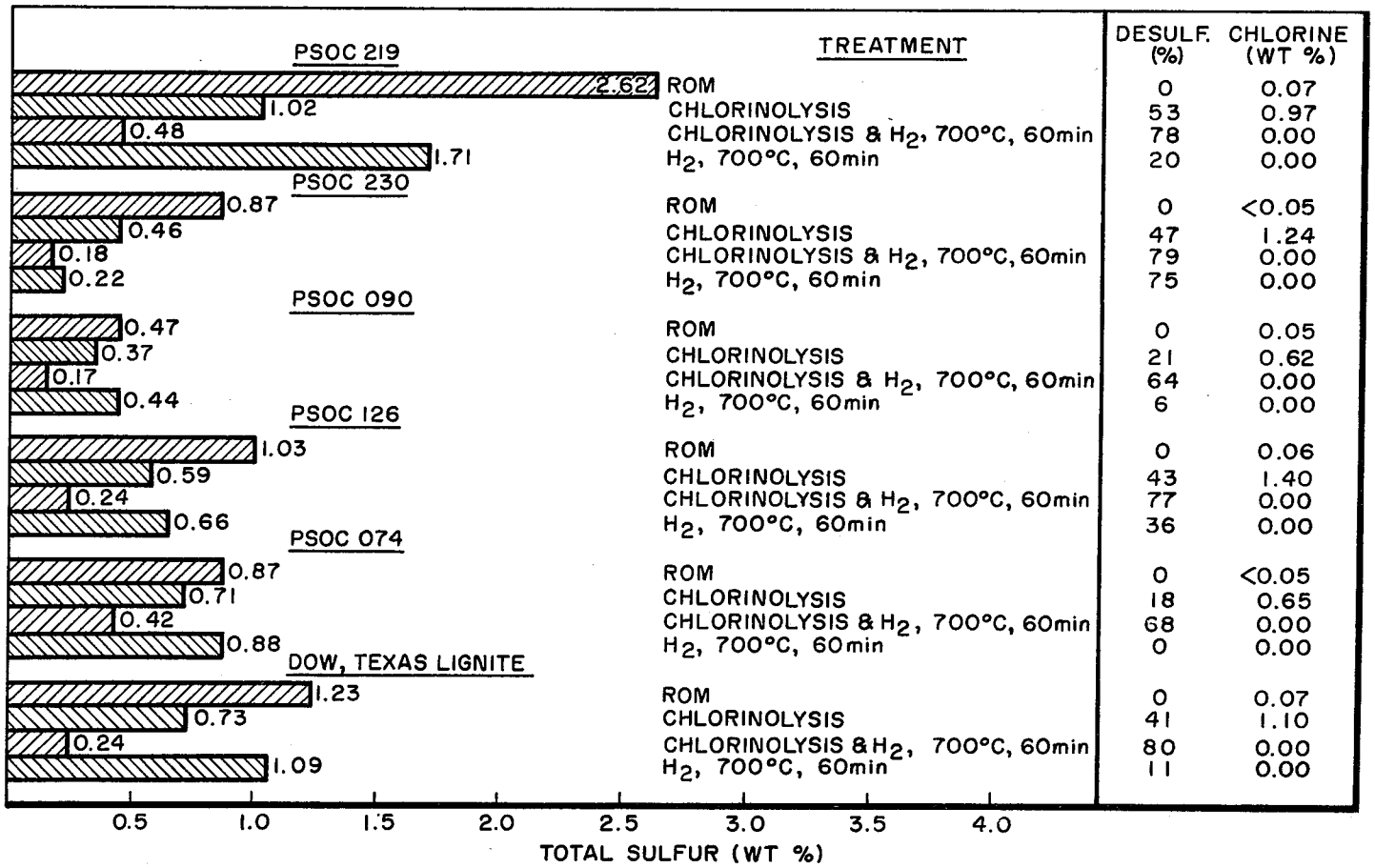
FIG. 5 is a series of bar graphs presenting desulfurization data on six further types of coals.

Six further types of coal containing 0.47 to 2.62 weight percent sulfur were processed according to the procedure of Example 1. Analyses of these coals are presented in FIG. 5.

Hydrogen treatment of these six chlorinolysis treated coals at 700° C. for 60 minutes increased desulfurization from 18 to 53% to 64 to 80% desulfurization. Hydrogen treatment of the raw coals under the same conditions resulted in 0 to 75% desulfurization.

Increasing temperature during the hydrogen treatment of PSOC 282 coal from 400° to 600° C. increased desulfurization from 72 to 90%. Dechlorination increased from 3.1 weight percent to 0.17 weight percent chlorine at 500° C. Increasing the temperature to 700° C. increased the levels of desulfurization from 60% to 84–90% and the accompanying chlorine level was reduced to 0.04 weight percent. A level of 80% desulfurization with 0.3 weight percent residual sulfur exceeds EPA sulfur emission requirements for New Source Performance Standards (NSPS).

It is to be realized that only preferred and exemplary embodiments of the invention have been illustrated and that numerous substitutions, alterations and modifications are all permissible without departing from the spirit and scope of the invention as defined in the following claims:

We claim:

1. A method of desulfurizing coal containing at least 0.2% sulfur comprising the steps of:

(1) chlorinating the coal by forming a slurry of coal in liquid media and bubbling chlorine gas into the slurry to convert sulfur in the coal into water soluble sulfates;

(2) subjecting the chlorinated coal to a gaseous reducing agent consisting essentially of hydrogen or a hydrogen donor gas at a temperature from 500° C. to 700° C. until at least 70% of the sulfur is removed from the coal and the chlorine content is below 1%; and (3) recovering a desulfurized and dechlorinated coal.

2. A method according to claim 1 in which the liquid media is water.

3. A method according to claim 1 in which dechlorination is simultaneously conducted during step (2).

4. A method according to claim 3 in which the temperature is from 500° C. to 700° C. and the gas is hydrogen.

5. A method according to claim 4 in which $H_2S$ is evolved during step (3) and the $H_2S$ is recovered and separated from hydrogen and evolved volatiles.

6. A method according to claim 4 in which the coal is selected from bituminous, sub-bituminous or lignite.

7. A method according to claim 6 in which the coal is desulfurized in an amount up to 90% by weight.

8. A method according to claim 6 in which the coal is from 40 to 325 mesh.

* * * * *